US006659922B1

(12) United States Patent
Yu

(10) Patent No.: US 6,659,922 B1
(45) Date of Patent: Dec. 9, 2003

(54) RESISTANCE ADJUSTMENT MECHANISM FOR EASY PULL EXERCISER

(75) Inventor: Hui-Nan Yu, Taoyuan (TW)

(73) Assignee: Jao-Hsing Tsai, Hsinchu (TW)

( * ) Notice: Subject to any disclaimer, the term of this patent is extended or adjusted under 35 U.S.C. 154(b) by 0 days.

(21) Appl. No.: 10/419,132

(22) Filed: Apr. 21, 2003

(51) Int. Cl.[7] ..... A63B 69/00
(52) U.S. Cl. ..... 482/127; 482/121
(58) Field of Search ..... 482/126, 127, 482/121, 122, 92, 124, 908–910

(56) References Cited

U.S. PATENT DOCUMENTS 5,733,231 A * 3/1998 Corn et al. ..... 482/120
6,149,559 A * 11/2000 Mackey ..... 482/124
6,224,523 B1 * 5/2001 Peng ..... 482/127

* cited by examiner

*Primary Examiner*—Glenn E. Richman
(74) *Attorney, Agent, or Firm*—Troxell Law Office PLLC

(57) ABSTRACT

A resistance adjustment mechanism for an easy pull exerciser mainly comprises an outer shell, adjustment device, winding wheel and gear axis. The outer shell is composed of the first and second shells. The first shell has an adjustment device containing a rotating knob, a retainer and a one-way clutch bearing. The retainer is clamped and attached to the first shell with outside for the rotating knob's thread stud to pass through. Normally, the teeth on gear axis match the inner ring gear of the second shell. A flexible arrangement for gear axis makes the gear axis rotate under inward pressure, so the degree of tightness for the spiral spring can be adjusted to control the resilient force for the pull string. Therefore, when back to the normal state, the gear axis is positioned to the inner ring gear. The mechanism provides easy adjustment and secured position for the gear axis.

2 Claims, 6 Drawing Sheets

RESISTANCE ADJUSTMENT MECHANISM FOR EASY PULL EXERCISER

FIELD OF THE INVENTION

The present invention is related to the resistance adjustment mechanism for an easy pull exerciser. Especially it means a simple control mechanism that provides variable frictional forces.

BACKGROUND OF THE INVENTION

Usually, a pull exerciser uses spiral spring as a return device for rewinding the pull. When the pull string is pulled, frictional resistance takes place between a friction device and the pull string, so a load applies to the user in exercise. But traditional pull exerciser does not have the function to adjust the frictional force for the pull string and the degree of tightness for the spiral spring. Practically, it does not meet the need for different users in exercise under different condition.

SUMMARY OF THE INVENTION

The main objective for the present invention is to provide a resistance adjustment mechanism for an easy pull exerciser, which uses a flexible moving gear axis to adjust the degree of tightness of a spiral spring when it rotates under inward pressure. The mechanism further controls the resilient force for the pull string and allows the gear axis to position to the inner ring gear when it is back to normal state. Thus, the gear axis can be adjusted easily and positioned securely.

Another objective for the present invention is to provide a mechanism to adjust the frictional force for the pull string, so the user can adjust the tightness for the pull string according to the practical condition and be satisfied with the exerciser.

DETAILED DESCRIPTION OF THE INVENTION

An embodiment is described in details with the following figures.

Figure 1:
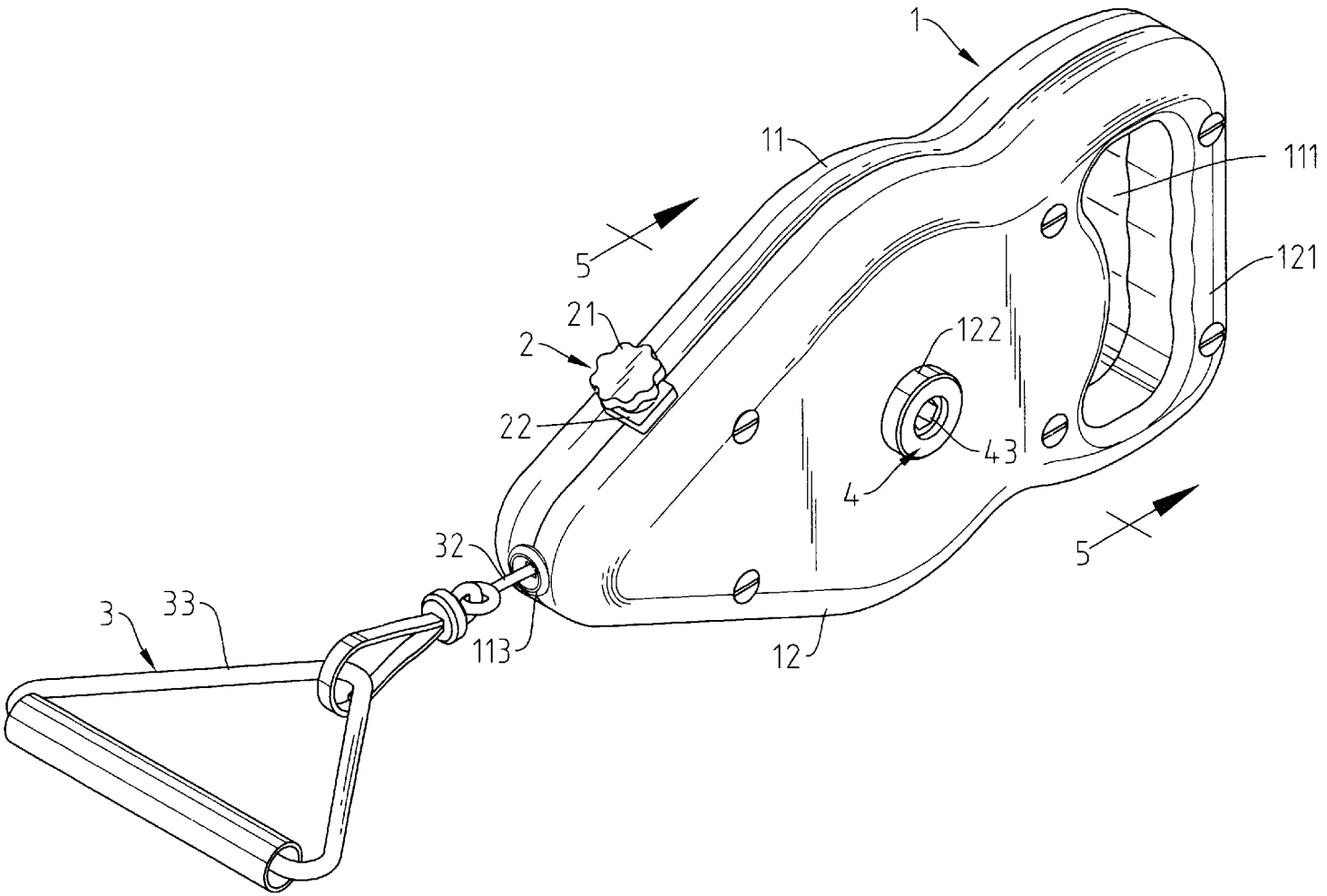
FIG. 1 is a three-dimensional view for the present invention.
Figure 2:
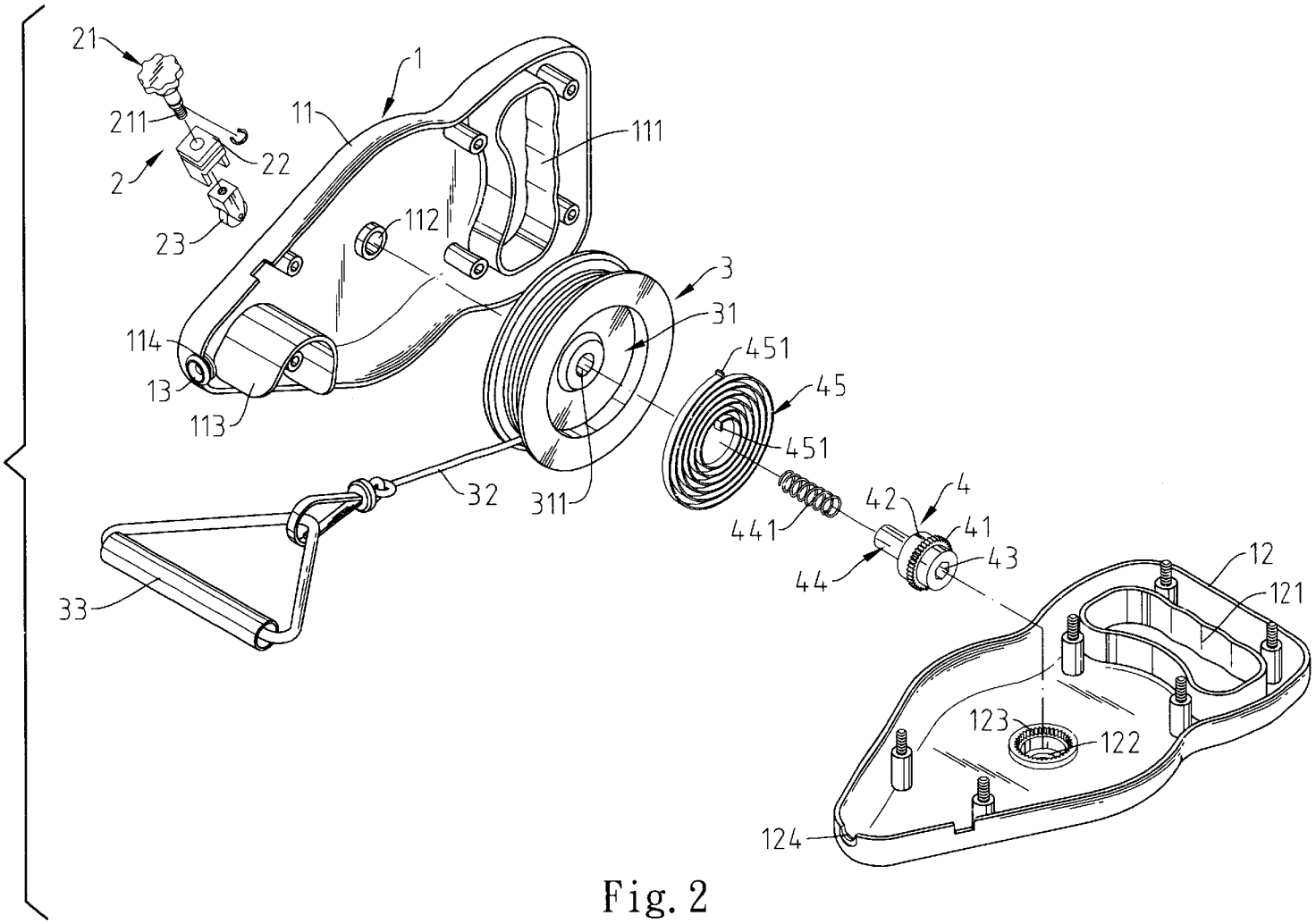
FIG. 2 is a three-dimensional de-compositional view for the present invention.
Figure 3:
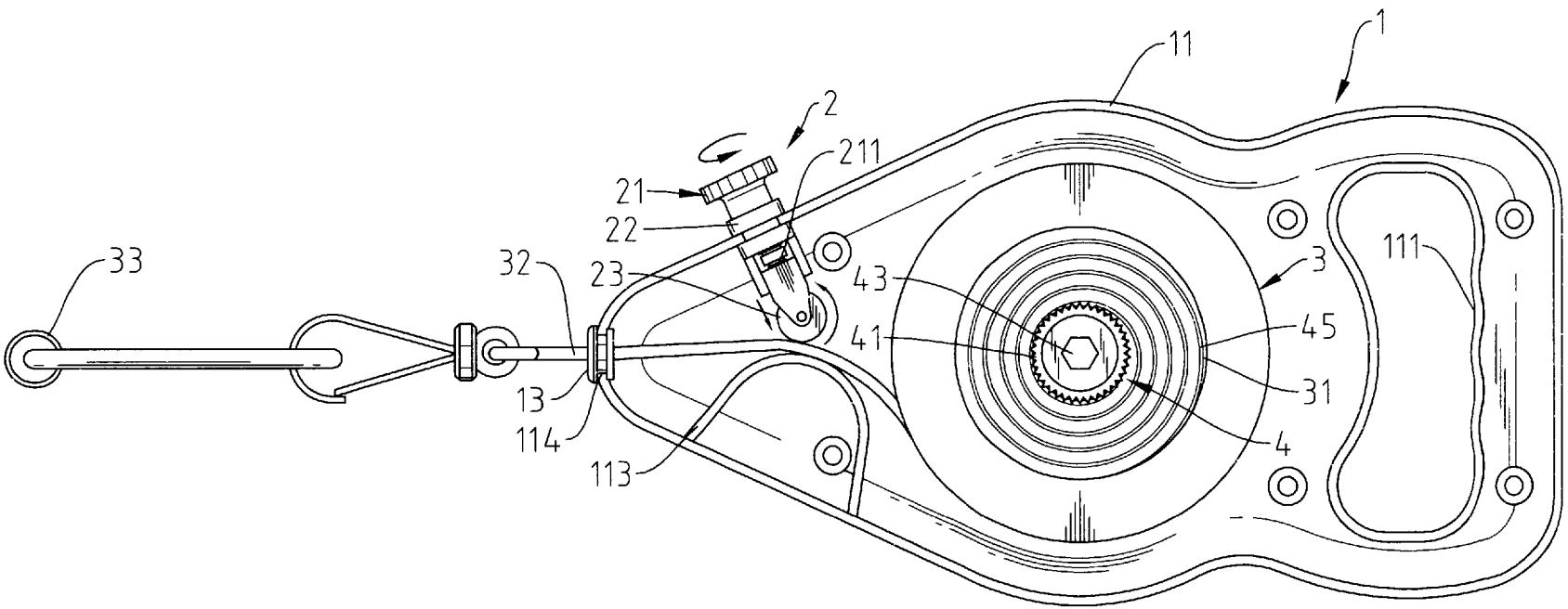
FIG. 3 is a two-dimensional illustration for the inner structure for the present invention.

Please refer to FIGS. 1 to 3. The pull exerciser for the present invention comprises an outer shell 1, an adjustment device 2, a winding wheel 3 and a gear axis 4. The outer shell 1 contains a pair of semi-spherical parts: the first shell 11 and the second shell 12. On one sides of the first shell 11 and the second shell 12, there are handles 111, 121 available for hand grasping. Near the center, there are axis holders 112, 122. On the other sides of the first shell 11 and the second shell 12, there are cavities 114, 124 available to firmly hold an adapter 13 and allow the pull string 32 for the winding wheel 3 to pass through. The winding wheel 3 is warped around by the pull string 32. One end of the pull string 32 is fixed to the winding wheel 3. The other end of the pull string 32 is fixed to a pull handle 33. The pull string 32 can pass through or be rewinded in the adapter 13.

Figure 4:
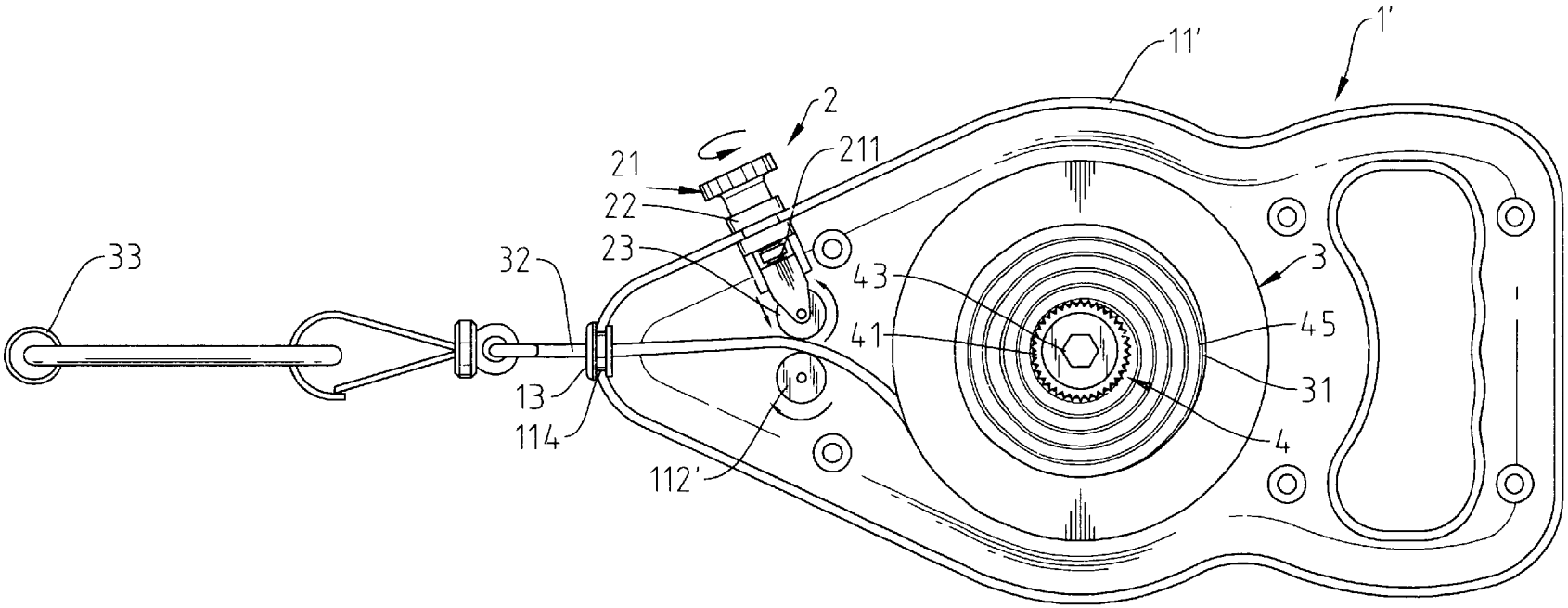
FIG. 4 is a two-dimensional illustration for the inner structure of another embodiment for the present invention.
Figure 5:
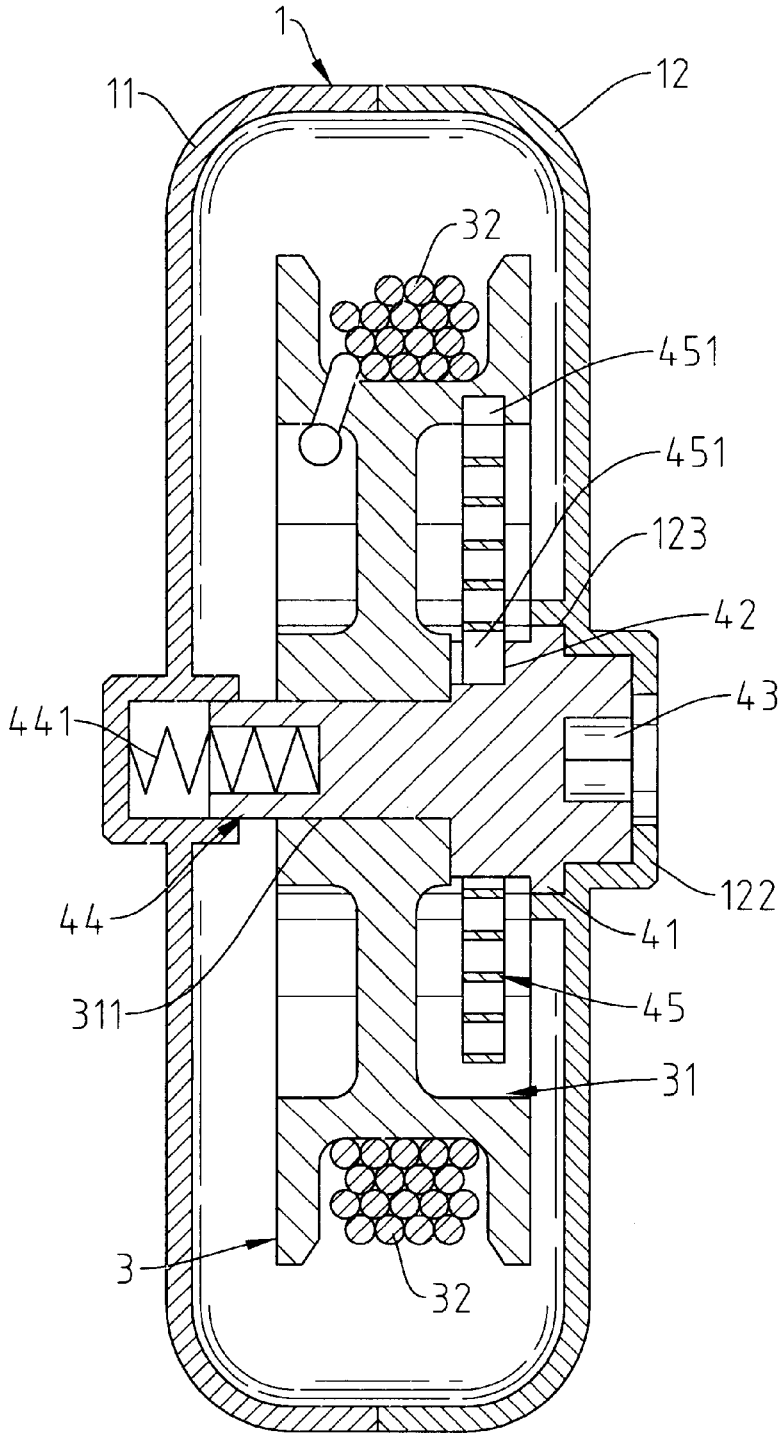
FIG. 5 is a cross-sectional view obtained through the direction of 5—5 cross-sectional line and arrow shown in FIG. 1.

Please refer to FIGS. 3 to 5. The said winding wheel 3 forms a side concavity 31 on one side for placing the spiral spring 45. The winding wheel 3 is located at the outer shell 1 by passing the gear axis 4 through. The outer bending terminal 451 for the spiral spring 45 is fixed to the side cavity 31 for the winding wheel 3. The inner bending terminal 451 for the spiral spring 45 is fixed to the positioning groove 42 for the gear axis 4. By pulling the pull string, the spiral spring 45 is deformed and twisted. When no pulling force is applied to the pull handle 33 of the pull string 32, the winding spring 45 is back to normal state and the winding wheel 3 is wrapped around by the pull string 32.

Please refer to FIG. 3. On the back of the said first shell 11 near the adapter 13, there is an adjustment device 2 that contains a rotating knob 21, retainer 22 and one-way clutch bearing 23. The retainer 22 is clamped and fixed to the first shell 11. The outside of the retainer 22 is available for the thread stud 211 of the rotating knob 21 to pass through. The thread stud 211 connects to the one-way clutch bearing 23. Through the rotating knob 21, the distance for the one-way clutch bearing 23 to move inward or outward can be adjusted. A curved plate 113 is located in front of the one-way clutch bearing 23 at a corresponding position to the adjustment device 2. The curved plate 113 allows the pull string 32 of the winding wheel 3 to move smoothly along the curved surface.

Please refer to FIG. 5 again. Inside the axis holder 122 for the second shell 12 of the outer shell 1, there is a inner ring gear 123 for holding the gear axis 4. There is a multilateral hole 43 at the outer end of the gear axis 4. On the gear axis 4, there is a circle of teeth 41. On the back, there is an extended hollow axis tube 44. There is an elastic device 441 inside the axis tube 44. Under normal condition, the teeth 41 for the gear axis 4 match the inner ring gear 123 for the second shell 12 due to the action of the elastic device 441. Because of the flexible arrangement of the gear axis 4, the gear axis can be pressed inward and rotate to adjust the degree of tightness of the spiral spring 45. Further, the resilient force for the pull string 32 can be controlled. Besides, when the gear axis 4 is back to normal state, the teeth 41 can be positioned to the inner ring gear 123. Thus, the mechanism provides easy adjustment and secured position for the gear axis 4.

Figure 6:
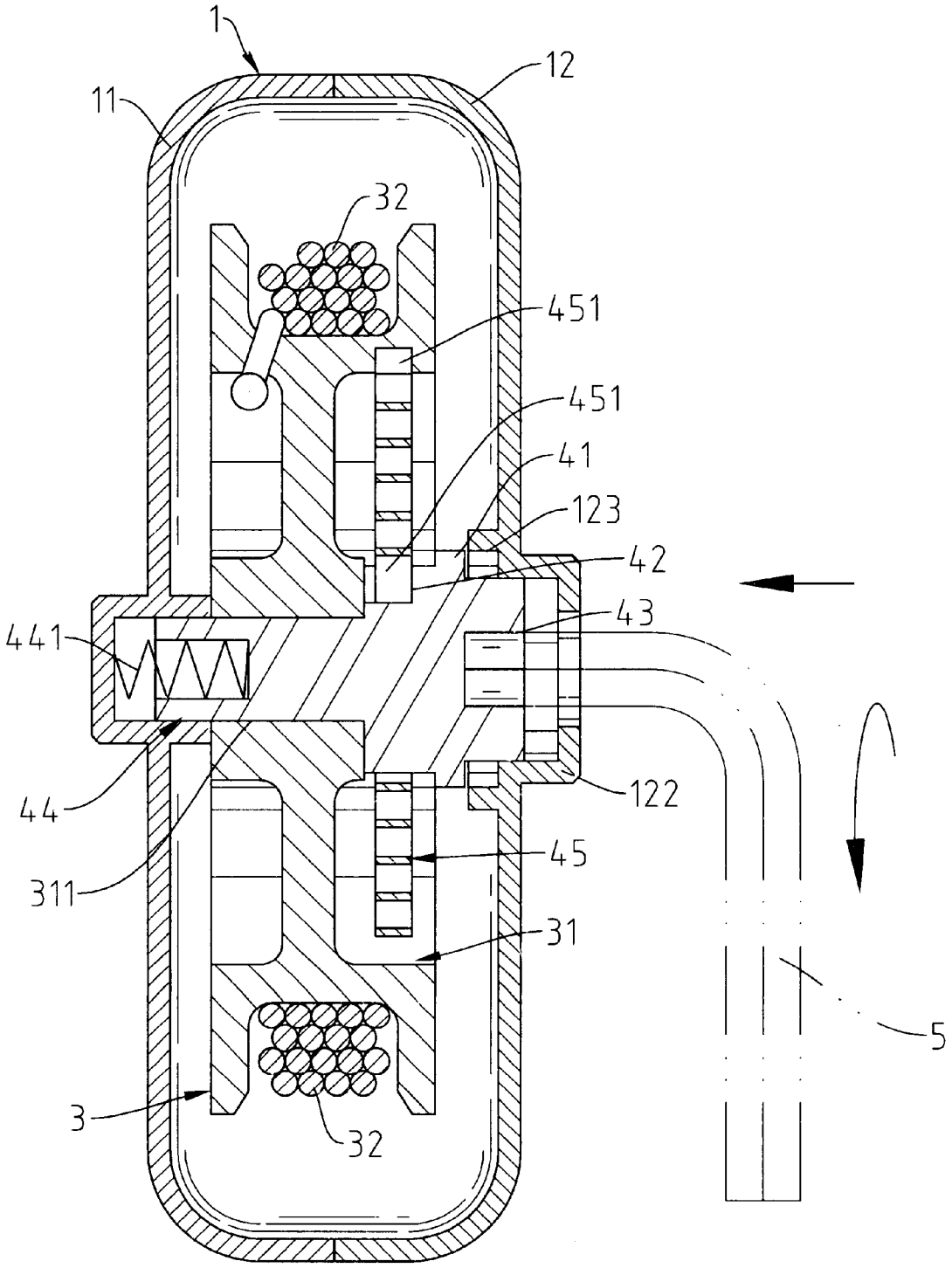
FIG. 6 is an illustration for the structure and the gear axis adjustment status shown in FIG. 5.

Furthermore, the curved plate 113 for the first shell 11' for the pull string 32 to move smoothly can be replaced by a one-way clutch bearing 112' as shown in FIG. 6. For the first shell 11', near one end of the pull string 32 for the winding wheel 3, there is an adjustment device 2, which contains a rotating knob 21, a retainer 22 and a one-way clutch bearing 23. The retainer 22 is clamped and fixed to the first shell 11'. The outside of the retainer 22 is available for the thread stud 211 of the rotating-knob 21 to pass through. The thread stud 211 connects to the one-way clutch bearing 23. A curved plate 112' is located in front of the one-way clutch bearing 23 for the outer shell 1' at a corresponding position to the adjustment device 2. The curved plate 112' allows the pull string 32 to move along its surface. Thus, the two one-way clutch bearings can limit the pulling action for the pull string 32 at the same time.

What is claimed is:

1. A resistance adjustment mechanism for an easy pull exerciser, mainly comprising an outer shell having a pair of semi-spherical shells, a handle on one side of said outer shell, a winding wheel inside said semi-spherical shells, a wrapping pull string on peripheral of said winding wheel, one end of said wrapping pull string fixed to said winding wheel and the other end to a pull handle located on other side of said outer shell, a side cavity formed on one side of said winding wheel for placing a spiral spring, said winding wheel placed on an outer shell by passing a gear axis through, said spiral spring fixed to said winding wheel at outer end and fixed to said gear axis at an inner end, when said pull spring is subject to pulling force, said spiral spring is deformed and twisted, when no force is applied to said pull string, said spiral spring is back to normal state and said winding wheel is wrapped around by said pull spring, characterized by that:

said outer shell contains a first shell and a second shell, an adjustment device is placed at one end of said pull string near said winding wheel, said adjustment device contains a rotating knob, a retainer and a one-way clutch bearing, said retainer is clamped and fixed to said first shell, outside of said retainer is available for said rotating knob to secure by passing a thread stud through, said thread stud can connect to said one-way clutch bearing, a curved plate is located on a front of said one-way clutch bearing inside said outer shell for said pull string to move along a curved surface; and inside an axis holder for said second shell, there is a ring gear for holding said gear axis, at an outer end of said gear axis, there is a multilateral hole, on said gear axis, there are teeth in a circle, at a rear part, there is an extended hollow axis tube incorporating an elastic device, under normal conditions, said teeth of said gear axis are retained to an inner ring gear due to action of said elastic device.

2. The resistance adjustment mechanism for an easy pull exerciser of claim 1, wherein in front of said adjustment device inside said outer shell, there is a one-way clutch bearing.

* * * * *